US009087498B2

(12) United States Patent
Sato et al.

(10) Patent No.: US 9,087,498 B2
(45) Date of Patent: Jul. 21, 2015

(54) TOM HOLDER

(71) Applicant: HOSHINO GAKKI CO., LTD., Nagoya, Aichi (JP)

(72) Inventors: Naoki Sato, Nagoya (JP); Shinji Noguchi, Nagoya (JP); Satoshi Hirasawa, Nagoya (JP)

(73) Assignee: HOSHINO GAKKI CO., LTD., Aichi (JP)

( * ) Notice: Subject to any disclaimer, the term of this patent is extended or adjusted under 35 U.S.C. 154(b) by 52 days.

(21) Appl. No.: 14/042,727

(22) Filed: Oct. 1, 2013

(65) Prior Publication Data

US 2014/0026737 A1 Jan. 30, 2014

Related U.S. Application Data

(63) Continuation-in-part of application No. 12/978,283, filed on Dec. 23, 2010, now Pat. No. 8,742,240.

(30) Foreign Application Priority Data

Nov. 16, 2010 (JP) ..... 2010-255663

(51) Int. Cl.
*G10D 13/02* (2006.01)

(52) U.S. Cl.
CPC ..... *G10D 13/026* (2013.01)

(58) Field of Classification Search
USPC ..... 84/421
See application file for complete search history.

(56) References Cited

U.S. PATENT DOCUMENTS

| | | | | | |
|---|---|---|---|---|---|
| 3,535,976 | A | * | 10/1970 | Osuga | 84/421 |
| 3,576,149 | A | * | 4/1971 | Slingerland, Jr. | 84/421 |
| 4,126,075 | A | | 11/1978 | Kurosaki | |
| 4,158,981 | A | * | 6/1979 | Kurosaki | 84/421 |
| 4,796,508 | A | * | 1/1989 | Hoshino | 84/421 |
| 4,987,817 | A | * | 1/1991 | Diaz | 84/421 |
| 5,566,911 | A | | 10/1996 | Hoshino | |
| 5,803,642 | A | | 9/1998 | Sassmannshausen | |
| 5,895,874 | A | * | 4/1999 | Liao | 84/421 |
| 5,973,248 | A | | 10/1999 | Chen | |
| 6,346,665 | B1 | * | 2/2002 | Liao | 84/421 |
| 8,106,278 | B2 | | 1/2012 | Eason | |
| 2007/0068365 | A1 | * | 3/2007 | Miyajima | 84/421 |

FOREIGN PATENT DOCUMENTS

| | | | |
|---|---|---|---|
| JP | 59-1094 | U | 1/1984 |
| JP | 61-132899 | U | 8/1986 |
| JP | 63-24598 | U | 2/1988 |
| JP | 3004275 | U | 8/1994 |
| JP | 3014483 | U | 5/1995 |
| JP | 2007-079437 | A | 3/2007 |

OTHER PUBLICATIONS

U.S. Office Action dated Dec. 5, 2013 issued in the U.S. Appl. No. 12/978,283.

* cited by examiner

*Primary Examiner* — Christopher Uhlir

(57) ABSTRACT

A tom holder has a holder body, a pivoting member supported pivotally with respect to the holder body, and a rod, which projects from the pivoting member with the tom fixed to the rod. The tom holder has a pair of openings located at opposed positions. The tom holder is configured to be usable in either a first mode, in which the rod projects from the first opening, and a second mode, in which the rod projects from the second opening.

7 Claims, 16 Drawing Sheets

TOM HOLDER

CROSS-REFERENCE TO RELATED APPLICATIONS

This application is a continuation-in-part of prior copending patent application Ser. No. 12/978,283 filed on Dec. 23, 2010.

BACKGROUND OF THE INVENTION

The present invention relates to a tom holder used to attach a tom to a musical instrument stand.

Typically, a drum set includes percussion instruments such as a bass drum, a snare drum, a tom, and cymbals, which are arranged in such a manner as to allow a single player to play the instruments. Specifically, the tom may be supported by a cymbal stand using a clamp and a tom adapter. However, this supporting method requires a plurality of components to support the tom from the cymbal stand, thus increasing costs.

As described in U.S. Pat. No. 6,346,665, for example, a tom holder functioning as both a clamp and a tom adapter has been proposed. With reference to FIG. 11, a tom holder 100, as disclosed in this document, includes a holder 102 formed integrally with a sleeve 101, a ball 103 supported by the holder 102, and a rod 104, which is fixed to the ball 103, extends in an L-shaped manner. The holder 102 has a clamp structure configured by a pair of clamp pieces 102*a*, 102*b*. The ball 103 is pivotally supported by the clamp pieces 102*a*, 102*b*. The rod 104 projects from an opening 105, which is formed in a front surface of the holder 102. A tom T is fixed to a portion of the rod 104 extending upward through a fixing tool TA. This type of tom holder 100 is attached directly to a support pipe BP extending from a bass drum B through the sleeve 101. The position of the tom T, which is fixed to the rod 104, may be adjusted by pivoting the ball 103 received in the holder 102. The tom holder 100 may be used to attach the tom T to a cymbal stand or a support pipe of a tom stand, other than the mode of use illustrated in FIG. 11.

However, the tom holder 100 shown in FIG. 11 has only one opening, which is the opening 105 formed in the front surface of the holder 102. The area of the opening 105, which defines the movement range of the rod 104, is set to a comparatively small value. This reduces the movement range of the rod 104 and thus the adjustment range of the position of the tom T. To enlarge the adjustment range of the position of the tom T, the bass drum or the cymbal stand must be moved, which is troublesome and complicated for the player. If the cymbal stand is moved, the positions of the cymbals must be readjusted, which involves otherwise unnecessary work.

SUMMARY OF THE INVENTION

Accordingly, it is an objective of the present invention to provide a tom holder that is capable of enlarging the adjustment range of the position of a tom.

To achieve the foregoing objective and in accordance with the first aspect of the present invention, a tom holder used to attach a tom to a support pipe is provided. The tom holder includes a holder body, a pivoting member supported pivotally with respect to the holder body, and a rod projecting from the pivoting member. The tom is fixed to the rod. A pair of openings is formed in the holder body. The openings are arranged at opposed positions. The tom holder is configured to be usable in either a first mode, in which the rod projects from a first opening, or a second mode, in which the rod projects from a second opening.

To achieve the foregoing objective and in accordance with the second aspect of the present invention, a tom holder comprises a support rod fixed to a structure and a mounting body on which a tom is mounted. The mounting body is arranged on an upper portion of the support rod. The mounting body has a holder body and a pivoting component. The holder body is attached to the upper portion of the support rod, and the pivoting component is supported pivotally with respect to the holder body. The pivoting component has a U-shaped rod to which the tom is attached. A lower surface of the holder body has an opening from which the U-shaped rod projects. The pivoting component is supported by the holder body with the U-shaped rod projecting downward from the opening in the holder body, and a distal end of the U-shaped rod facing upward.

DETAILED DESCRIPTION OF THE PREFERRED EMBODIMENTS (First Embodiment)

A first embodiment of a tom holder according to the present invention will now be described with reference to FIGS. 1 to 6B.

Figure 1:
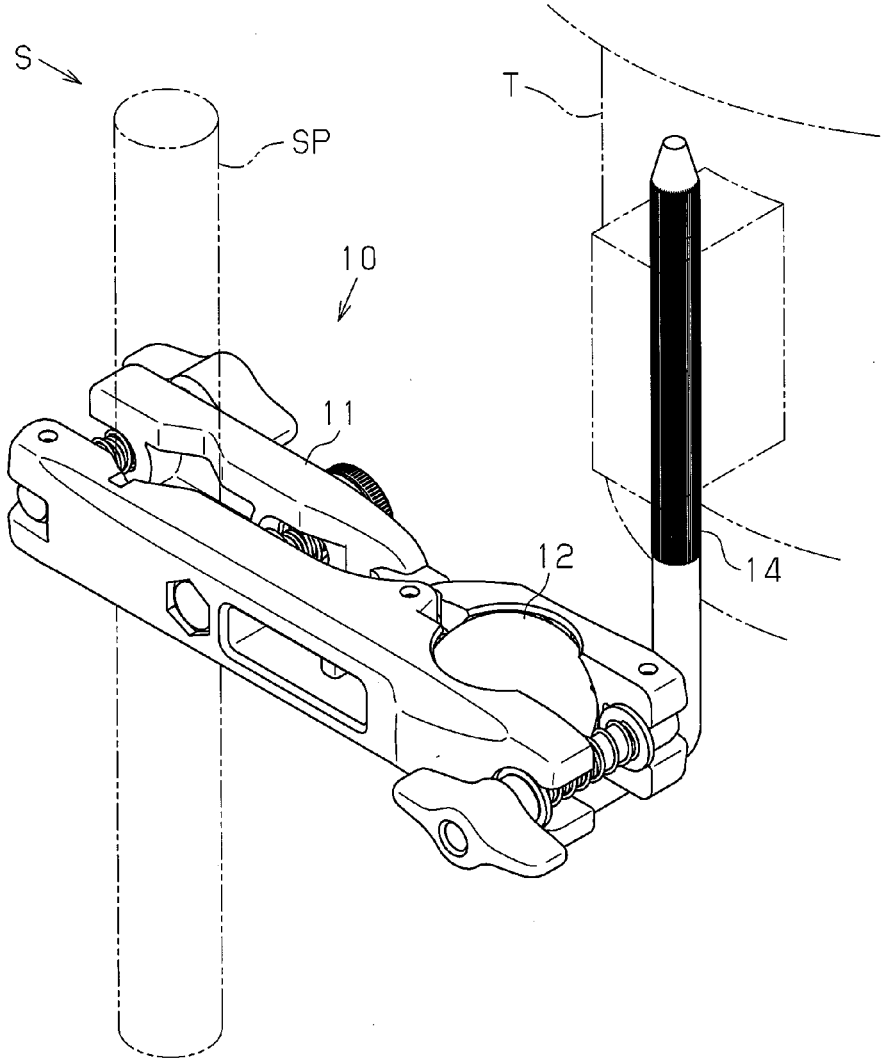
FIG. 1 is a perspective view showing a tom holder according to a first embodiment of the present invention.

As illustrated in FIG. 1, a tom holder 10 has a holder body 11, a pivoting member 12 supported pivotally with respect to the holder body 11, and a rod 14 to which a tom T is fixed. The tom holder 10 is used to attach the tom T to a support pipe SP of a cymbal stand S.

Figure 2:
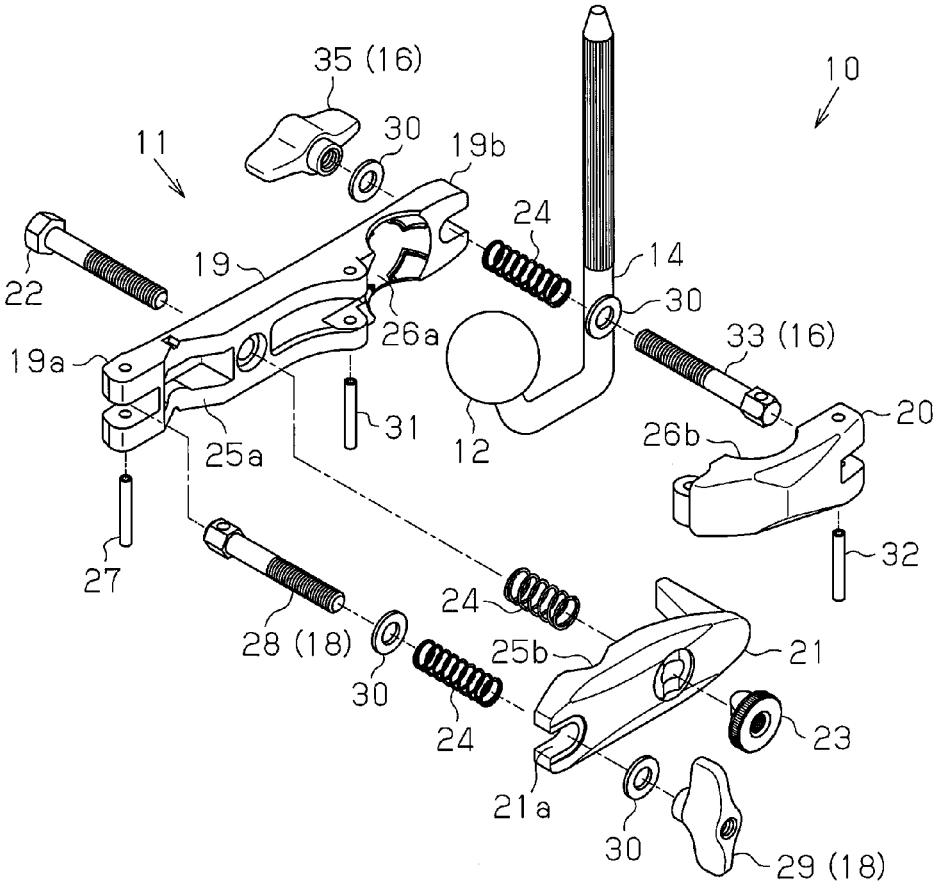
FIG. 2 is an exploded perspective view showing the tom holder.
Figure 3:
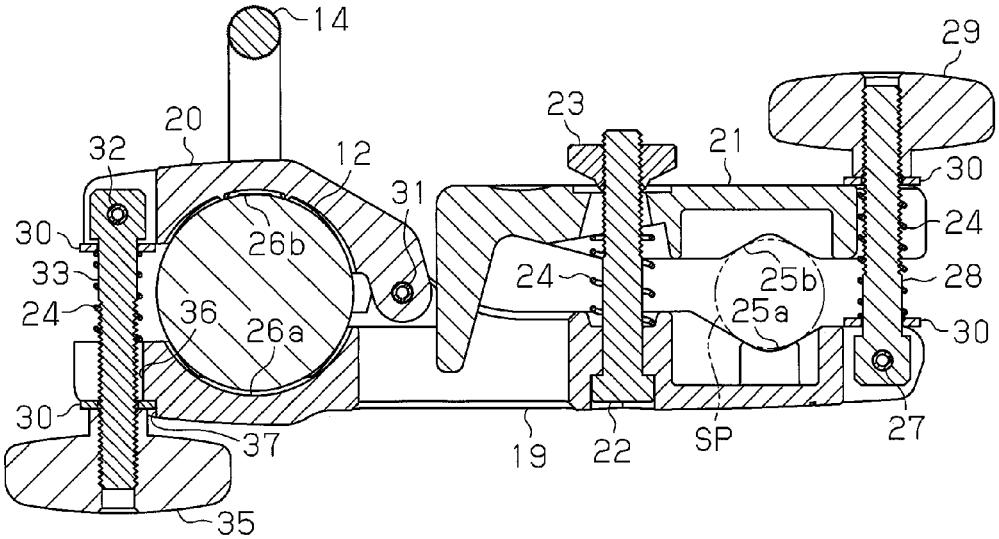
FIG. 3 is an upper cross-sectional view showing the tom holder.

As illustrated in FIGS. 2 and 3, the pivoting member 12 is made of synthetic resin and shaped spherically. The rod 14 is made of metal and has a U shape. The rod 14 projects from the pivoting member 12 and is fixed to the pivoting member 12. The rod 14 and the pivoting member 12 are formed as an integral component and incorporated in the holder body 11.

The holder body 11 has a first clamp structure and a second clamp structure. The first clamp structure clamps the pivoting member 12 by means of a first fastening member 16. The second clamp structure clamps the support pipe SP by means of a second fastening member 18. The holder body 11 has an elongated clamp body 19, a first clamp piece 20, and a second clamp piece 21. The first clamp piece 20, together with the clamp body 19, configures the first clamp structure. The second clamp piece 21, together with the clamp body 19, configures the second clamp structure.

A bolt 22 is supported at a center portion of the clamp body 19 with the distal end of the bolt 22 facing sideward. The distal end of the bolt 22 extends through the center portion of the second clamp piece 21. A nut 23 is threaded onto the distal end of the bolt 22. A coil spring 24 is arranged around the shaft portion of the bolt 22. A recess 25*a* having a triangular cross section is formed in the inner surface of the clamp body 19 that faces the second clamp piece 21. A recess 26*a*, which forms a part of a sphere, is formed in the inner surface of the clamp body 19 facing the first clamp piece 20.

The proximal end of a second bolt 28 is pivotally connected to a first end 19*a* of the clamp body 19 through a support pin 27. A butterfly nut 29 serving as a second nut is threaded onto the distal end of the second bolt 28. Another coil spring 24 and a washer 30 are arranged around the shaft portion of the second bolt 28. The second bolt 28 and the butterfly nut 29 configure the second fastening member 18.

The second clamp piece 21 is detachably attached to the clamp body 19. The second clamp piece 21, together with the clamp body 19, supports the support pipe SP from lateral sides. For this purpose, a recess 25*b* having a triangular cross section is formed in the inner surface of the second clamp piece 21 in a similar manner to the corresponding recess in the clamp body 19. A space for accommodating the support pipe SP is formed between the recess 25*b* of the second clamp piece 21 and the recess 25*a* of the clamp body 19. A support recess 21*a* for supporting the shaft portion of the second bolt 28 is formed at a distal end of the second clamp piece 21.

The first clamp piece 20 is fastened to a second end 19*b* of the clamp body 19 by means of the first fastening member 16. The first clamp piece 20 is detachably attached to the clamp body 19. The first clamp piece 20, together with the clamp body 19, supports the pivoting member 12 from lateral sides. For this purpose, a recess 26*b*, which forms a part of a sphere, is formed in the inner surface of the first clamp piece 20 in a similar manner to the corresponding recess in the clamp body 19. The space for accommodating the pivoting member 12 is formed between the recess 26*b* of the first clamp piece 20 and the recess 26*a* of the clamp body 19.

The first clamp piece 20 is pivotally connected to the clamp body 19 through a support pin 31. The proximal end of a first bolt 33 is pivotally connected to a distal end of the first clamp piece 20 through a support pin 32. A butterfly nut 35 serving as a first nut is threaded onto the distal end of the first bolt 33. Another coil spring 24 and another washer 30 are arranged around the shaft portion of the first bolt 33. The first bolt 33 and the butterfly nut 35 configure the first fastening member 16.

Figure 4:
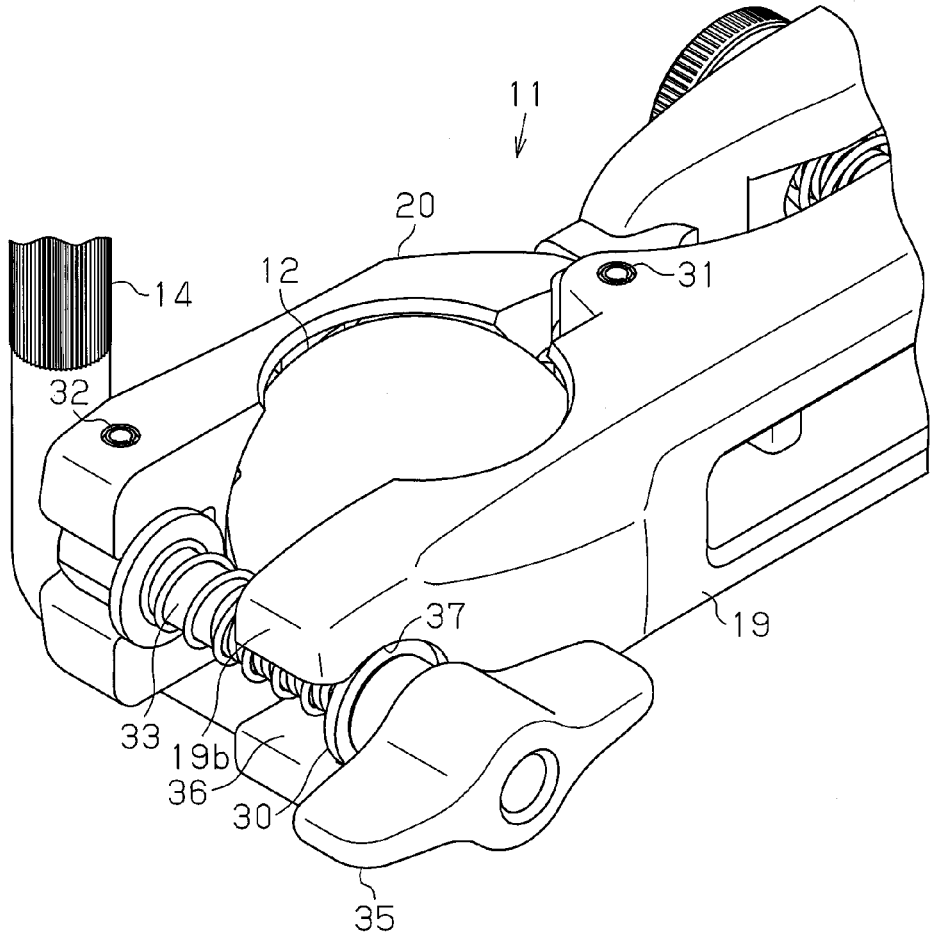
FIG. 4 is an enlarged partial perspective view showing a first clamp structure of the tom holder.

With reference to FIGS. 3 and 4, a support recess 36 for supporting the shaft portion of the first bolt 33 is formed in the second end 19*b* of the clamp body 19. A groove 37 having a shape corresponding to the shape of the washer 30 is formed in a distal end of the clamp body 19. The groove 37 is arranged adjacent to the support recess 36. The groove 37 in the clamp body 19 is sized and shaped in such a manner as to allow the washer 30 to be fitted in the groove 37 by fastening the butterfly nut 35. The groove 37 in the clamp body 19 and the washer 30 are restriction means for restricting pivot of the first bolt 33 with respect to the holder body 11. In other words, even if the butterfly nut 35 is loosened, the groove 37 in the clamp body 19 and the washer 30 maintain and prevent the first bolt 33 from pivoting with respect to the holder body 11 as long as the loosening amount of the butterfly nut 35 is not more than a predetermined value.

Operation of the tom holder 10 will hereafter be described with reference to FIGS. 5A to 6B.

Figure 5A:
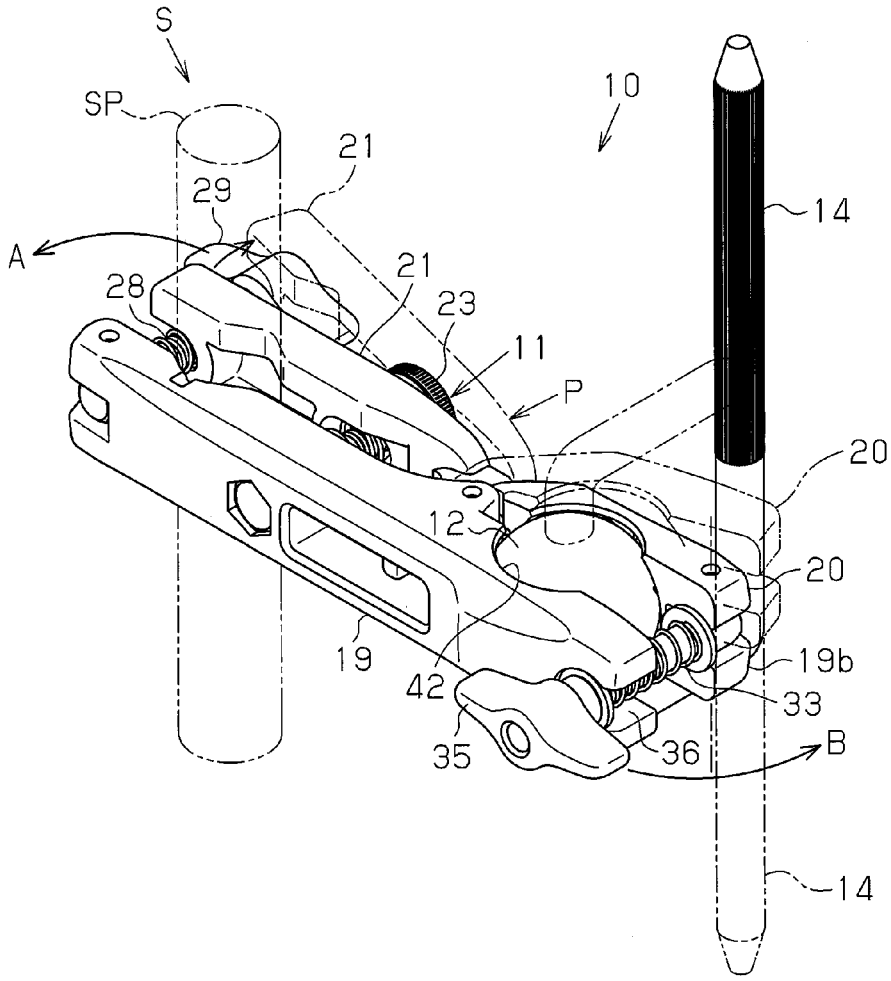
FIG. 5A is a perspective view showing a first mode of the tom holder.
Figure 5B:
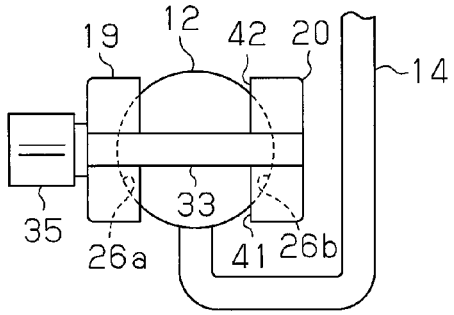
FIG. 5B is a front view schematically showing the first mode of the tom holder.

As illustrated in FIGS. 5A to 6B, the tom holder 10 has a pair of openings 41, 42, which are arranged at opposed positions. FIGS. 5A and 53 show the tom holder 10 in a first mode, in which the first opening 41 is located in a lower surface of the holder body 11, and the second opening 42 is arranged in an upper surface of the holder body 11. The first opening 41 is an opening facing downward, as viewed in FIGS. 5A and 5B, in the space between the recess 26*b* of the first clamp piece 20 and the recess 26*a* of the clamp body 19. The second opening 42 is an opening facing upward, as viewed in FIGS. 5A and 5B, in the space between the recess 26*b* of the first clamp piece 20 and the recess 26*a* of the clamp body 19. In the first mode, the pivoting member 12 is clamped between the clamp body 19 and the first clamp piece 20 with the rod 14 projecting from the opening 41 and the distal end of the rod 14 extending upward. In this mode, the rod 14 is located at the opposite side to the butterfly nut 35 with respect to the holder body 11.

To remove the tom holder 10 from the support pipe SP of the cymbal stand S, the butterfly nut 29 is loosened from the second bolt 28, and then the second bolt 28 is rotated in direction A, as indicated in FIG. 5A, with respect to the clamp body 19. Subsequently, the proximal end of the second clamp piece 21 is pressed in direction P, as indicated in FIG. 5A. This separates the distal end of the second clamp piece 21 from the clamp body 19, as indicated by the corresponding alternate long-and-two-short dashed lines in FIG. 5A, thus opening the end of the holder body 11 that fastens the support pipe SP. Through the series of operation, the tom holder 10 is detached from the support pipe SP of the cymbal stand S.

Next, the tom holder 10 is switched from the first mode to a second mode. Specifically, the butterfly nut 35 is first loosened from the first bolt 33, and then the first bolt 33 is rotated in direction B, as indicated in FIG. 5A, with respect to the first clamp piece 20. Subsequently, as indicated by the corresponding alternate long-and-two-short dashed lines in the drawing, the first clamp piece 20 is pivoted with respect to the clamp body 19 so as to separate the distal end of the first clamp piece 20 from the clamp body 19. This opens the end of the holder body 11 that fastens the pivoting member 12. Then, the pivoting member 12 may be pivoted in the holder body 11 or removed from the holder body 11, re-oriented, and mounted in the holder body 11, in such a manner that the rod 14 projects from the second opening 42 with the distal end of the rod 14 facing downward, as indicated by the corresponding alternate long-and-two-short dashed lines in FIG. 5A. After the pivoting member 12 is re-oriented in this manner, the open end of the holder body 11 is closed and the first bolt 33 is arranged in the support recess 36 in the clamp body 19. The butterfly nut 35 is then fastened to the first bolt 33. As a result, the pivoting member 12 is clamped between the clamp body 19 and the first clamp piece 20 in the state illustrated by the corresponding alternate long-and-two-short dashed lines in FIG. 5A.

Figure 6A:
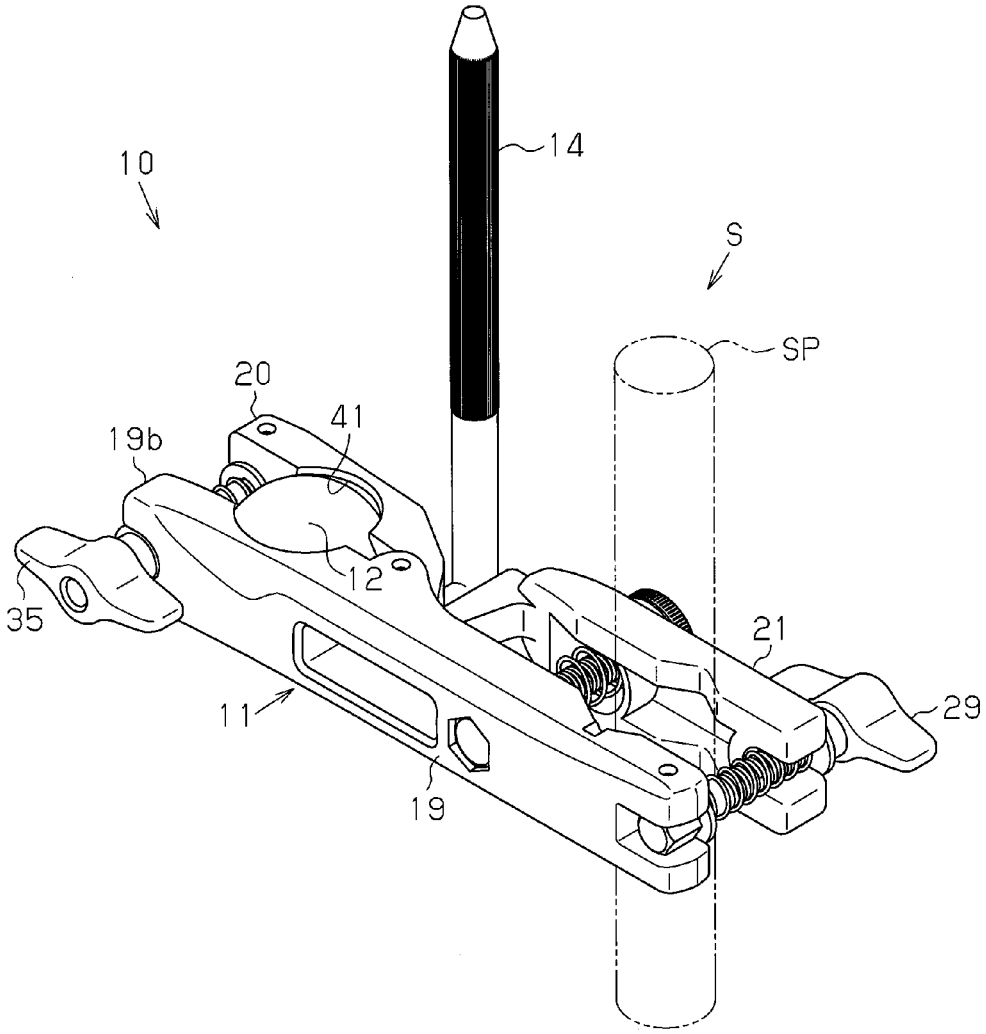
FIG. 6A is a perspective view showing a second mode of the tom holder.
Figure 6B:
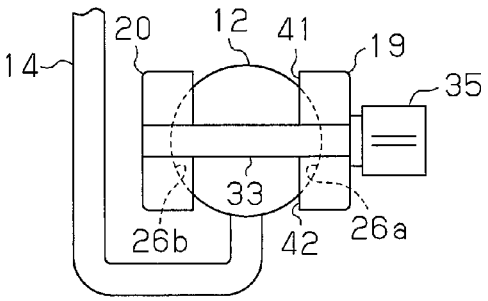
FIG. 6B is a front view schematically showing the second mode of the tom holder.

Further, as illustrated in FIGS. 6A and 6B, the tom holder 10 is reversed upside down, and then the tom holder 10 is attached to the support pipe SP of the cymbal stand S. FIGS. 6A and 6B show the tom holder 10 in the second mode, in which the second opening 42 is arranged in a lower surface of the holder body 11 and the first opening 41 is located in an upper surface of the holder body 11. Also in this mode, the rod 14 is arranged at the opposite side to the butterfly nut 35 with respect to the holder body 11. To attach the tom holder 10 to the support pipe SP, the removal procedure of the tom holder 10 from the support pipe SP is performed in reverse order.

The first embodiment has the advantages described below.

(1) The tom holder 10 has the two openings 41, 42, which are located at opposed positions. In this configuration, the movement range of the rod 14 is ensured at each of the opposed positions of the holder body 11. In other words, the tom holder 10 may be employed in either the first mode, in which the rod 14 projects from the first opening 41, or the second mode, in which the rod 14 projects from the second opening 42. As a result, compared to the conventional configuration having the only one opening formed in the front surface of the clamp, the movement range of the rod 14 is enlarged, thus also enlarging the adjustment range of the position of the tom T.

(2) The pivoting member 12 is formed in a spherical shape. The recess 26*a*, which forms a part of a sphere, is formed in the inner surface of the clamp body 19 facing the first clamp piece 20. Also, the recess 26*b*, which forms a part of a sphere, is arranged in the inner surface of the first clamp piece 20. In this configuration, the recess 26*a* in the clamp body 19 and the recess 26*b* of the first clamp piece 20 hold the pivoting member 12 in a pivotal manner. This further enlarges the movement range of the rod 14, thus enlarging the adjustment range of the position of the tom T to a greater extent.

(3) The holder body 11 has the first clamp structure, which fastens and holds the pivoting member 12 by means of the first fastening member 16. The proximal end of the first bolt 33, which forms the first fastening member 16, is pivotally connected to the distal end of the first clamp piece 20. In this configuration, by pivoting the first bolt 33 with respect to the first clamp piece 20, the portion of the holder body 11 for clamping the pivoting member 12 is opened. This facilitates attachment and detachment of the pivoting member 12 with respect to the holder body 11. Since the first bolt 33 is connected to the holder body 11 in advance, the first bolt 33 and the butterfly nut 35 are prevented from separating from the holder body 11.

(4) There are cases in which the butterfly nut 35 is loosened only slightly from the first bolt 33 in order to, for example, pivot the pivoting member 12 in the holder body 11 and adjust the position of the tom T. In these cases, the first bolt 33 may be released from the support recess 36 of the clamp body 19 to open the end of the holder body 11 that holds the pivoting member 12, thus causing the tom T to fall. However, according to the present invention, the groove 37 in the clamp body 19 and the washer 30 are provided as the restriction means for restricting pivot of the first bolt 33 with respect to the holder body 11. Accordingly, even if the butterfly nut 35 is loosened, the restriction means restricts the pivot of the first bolt 33 with respect to the holder body 11 as long as the loosening amount of the butterfly nut 35 is not more than the predetermined value. This stops the end of the holder body 11 holding the pivoting member 12 from opening at an undesirable time. As a result, when the butterfly nut 35 is loosened from the first bolt 33, the end of the holder body 11 clamping the pivoting member 12 is prevented from opening and releasing the tom T.

In contrast, by loosening the butterfly nut 35 from the first bolt 33 by an amount greater than or equal to a predetermined value, the pivoting member 12 can be pivoted smoothly in the holder body 11 or removed from the holder body 11. This facilitates the operation for switching the tom holder 10 from the first mode to the second mode.

(5) The proximal end of the second bolt 28 is pivotally connected to the first end 19*a* of the clamp body 19. The holder body 11 has the second clamp structure that fastens and holds the support pipe SP by means of the second fastening member 18. This configuration allows attachment of the tom holder 10 to the support pipe SP of the cymbal stand S using the second bolt 28 and the butterfly nut 29. Further, by pivoting the second bolt 28 with respect to the holder body 11, the end of the holder body 11 clamping the support pipe SP is opened. This facilitates attachment and detachment of the tom holder 10 with respect to the support pipe SP. Switching from the first mode to the second mode, which involves upside-down reversal of the tom holder 10 and re-mounting of the tom holder 10 onto the support pipe SP, is also facilitated.

(6) The pivoting member 12 is clamped between the clamp body 19 and the first clamp piece 20 with the rod 14 projecting from the first opening 41 and the distal end of the rod 14 extending upward. This arrangement enlarges the movement range of the rod 14. As a result, the adjustment range of the position of the tom T is further enlarged.

(7) The rod 14 is arranged at the opposite side to the butterfly nut 35 with respect to the holder body 11. This arrangement prevents the tom T from interfering with the butterfly nut 35 when the butterfly nut 35 is fastened or loosened, unlike an arrangement having the rod 14 and the butterfly nut 35 arranged at the same side with respect to the holder body 11. As a result, the position of the tom T is adjusted easily.

(Second Embodiment)

A tom holder 50 according to a second embodiment of the present invention will now be described with reference to FIGS. 7 to 8B. Detailed description of components of the second embodiment that are like or the same as corresponding components of the first embodiment will be omitted herein.

Figure 7:
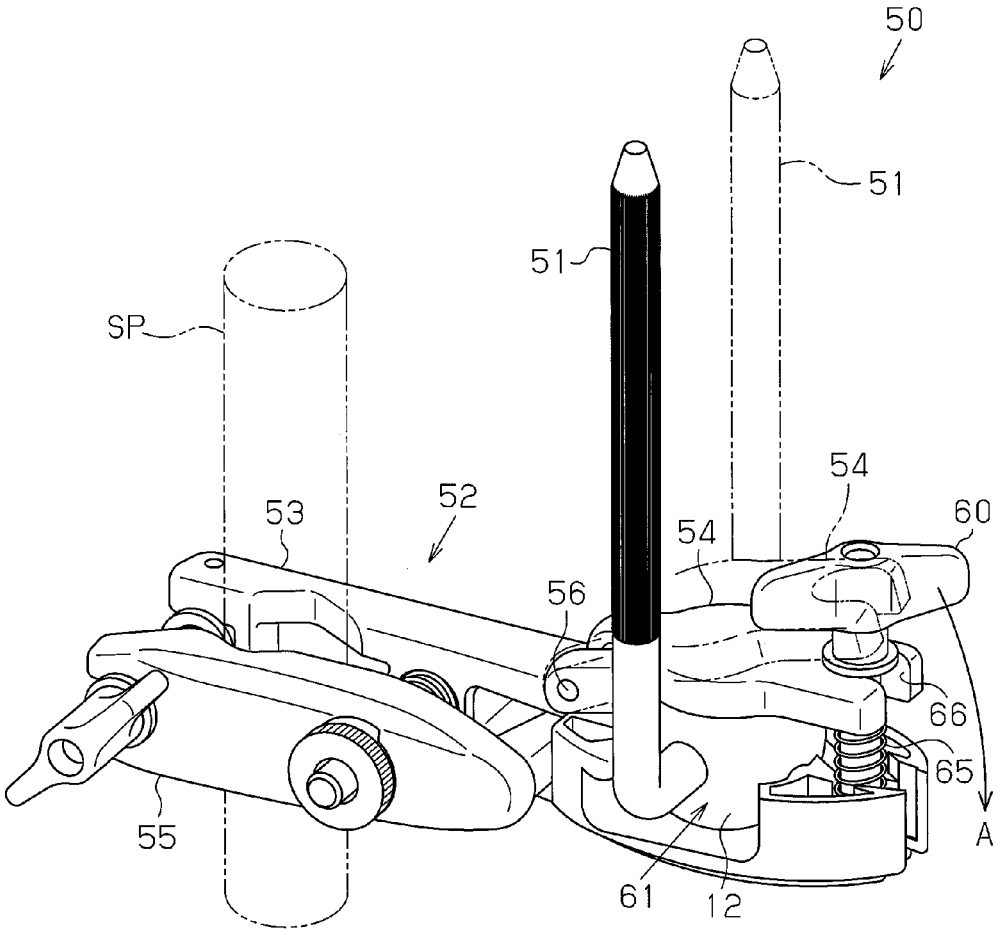
FIG. 7 is a perspective view showing a tom holder according to a second embodiment of the present invention.

As illustrated in FIG. 7, a rod 51 is formed in an L shape. A holder body 52 has an elongated clamp body 53, a first clamp piece 54 forming a first clamp structure together with the clamp body 53, and a second clamp piece 55 forming a second clamp structure together with the clamp body 53. The first clamp piece 54, together with the clamp body 53, supports the pivoting member 12 from above and below. The first clamp piece 54 is pivotally connected to the clamp body 53 through a support pin 56.

Operation of the above-described tom holder 50 will hereafter be described with reference to FIGS. 7 to 8B.

Figure 8A:
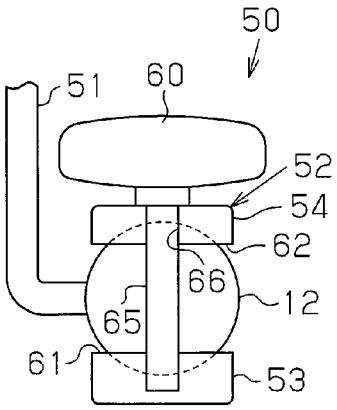
FIG. 8A is a front view schematically showing a first mode of the tom holder.
Figure 8B:
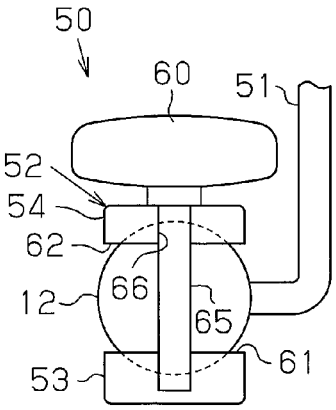
FIG. 8B is a front view schematically showing a second mode of the tom holder.

As illustrated in FIGS. 8A and 8B, the tom holder 50 has a pair of openings 61, 62, which are formed at opposed positions. FIGS. 7 and 8A show the tom holder 50 in a first mode, in which the first opening 61 is arranged in a left surface of the holder body 52 and the second opening 62 is located in a right surface of the holder body 52. In this mode, the pivoting member 12 is clamped between the clamp body 53 and the first clamp piece 54 with the rod 51 projecting from the first opening 61 and the distal end of the rod 51 extending upward.

To switch the tom holder 50 from the first mode to a second mode, a butterfly nut 60 is first loosened from a first bolt 65, and then the first bolt 65 is rotated in direction A, as indicated in FIG. 7, with respect to the clamp body 53. Subsequently, as indicated by the corresponding alternate long-and-two-short dashed lines in the drawing, the first clamp piece 54 is pivoted upward with respect to the clamp body 53 to open the end of the holder body 52 having the first clamp structure. Then, to project the rod 51 from the second opening 62, as indicated by the corresponding alternate long-and-two-short dashed lines in FIG. 7 and represented in FIG. 8B, the pivoting member 12 is pivoted in the holder body 52 with the distal end of the rod 51 maintained in a state facing upward.

Subsequently, the open end of the holder body 52 is closed and the first bolt 65 is arranged in a support recess 66 formed in the first clamp piece 54. The butterfly nut 60 is then fastened to the first bolt 65. This clamps the pivoting member 12 between the clamp body 53 and the first clamp piece 54 with the rod 51 projecting from the second opening 62 and the distal end of the rod 51 extending upward. Through this series of operation, the tom holder 50 is switched from the first mode to the second mode.

The second embodiment has the advantage described below.

(8) The tom holder 50 has the two openings 61, 62, which are located at opposed positions. In this configuration, as in the first embodiment, the movement range of the rod 51 is ensured at each of the opposed positions of the holder body 52. In other words, the tom holder 50 can be arranged in either the first mode, in which the rod 51 projects from the first opening 61, or the second mode, in which the rod 51 projects from the second opening 62. This configuration enlarges the movement range of the rod 51 and thus the adjustment range of the position of the tom T, compared to the conventional configuration having only one opening formed in the front surface of the clamp. Also, the above-described configuration allows switching of the tom holder 50 from the first mode to the second mode without removing the tom holder 50 from the support pipe SP.

The illustrated embodiments may be modified as follows.

Figure 9:
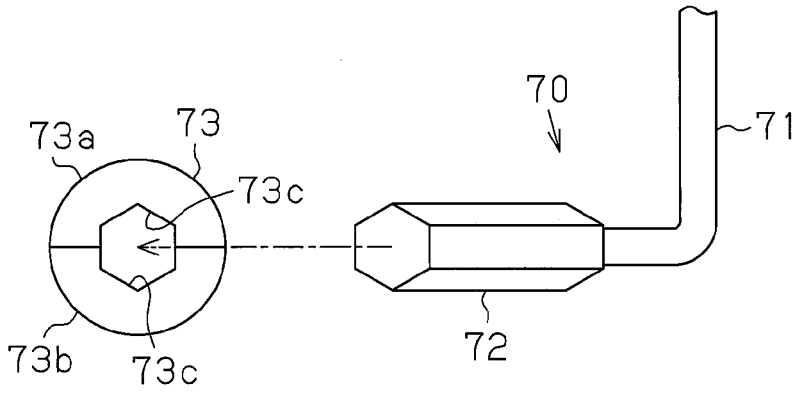
FIG. 9 is a view schematically showing a rod and a pivoting member of according to a modification.

In each of the above illustrated embodiments, the rod is fixed to the pivoting member. However, the rod may be formed in a manner attachable/detachable with respect to the pivoting member. For example, as illustrated in FIG. 9, a rod 70 has an L-shaped shaft portion 71 and a proximal portion 72 having a hexagonal cross section. A pivoting member 73 is divided into a first member 73*a* and a second member 73*b*. The first and second members 73*a*, 73*b* each have a groove 73*c*, which extends along the axis of the first or second member 73*a*, 73*b*. By arranging the grooves 73*c* of the first and second members 73*a*, 73*b* to face each other, a hole having a hexagonal cross section capable of receiving the proximal portion 72 of the rod 70 is formed. The pivoting member 73 is held pivotally by a holder body having a clamp structure. This configuration allows exchange of the rod 70 in correspondence with the type of tom and in response to needs of the player.

Figure 10A:
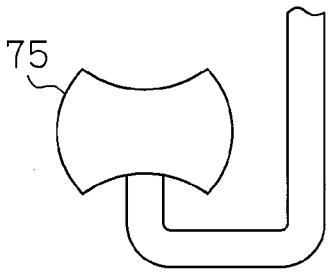
FIG. 10A is a view schematically showing a pivoting member according to another modification.
Figure 10B:
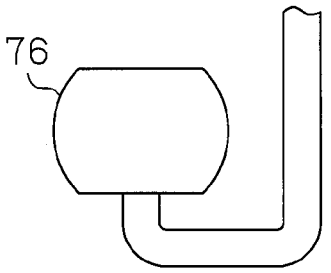
FIG. 10B is a view schematically showing a pivoting member according to another modification.

In each of the above illustrated embodiments, other than spherical bodies, pivoting members 75, 76 each formed by cutting portions of a spherical body, as illustrated in FIGS. 10A and 10B, may be employed.

In the first embodiment, the rod 14 may be arranged at the same side with the butterfly nut 35 with respect to the holder body 11.

In the second embodiment, the restriction means for restricting the pivot of the first bolt 65 may be arranged in an upper surface of the first clamp piece 54. The restriction means may be formed by, for example, a washer arranged between the butterfly nut 60 and the first clamp piece 54 and a groove that is formed in the upper surface of the first clamp piece 54 and receives the washer, as in the first embodiment.

In the first and second embodiments, the tom holders 10, 50 may be employed to attach the tom T to a tom stand or a support pipe of a bass drum, other than the cymbal stand.

(Third Embodiment)

A third embodiment of a tom holder according to the present invention will now be described with reference to FIGS. 12 to 17.

Figure 12:
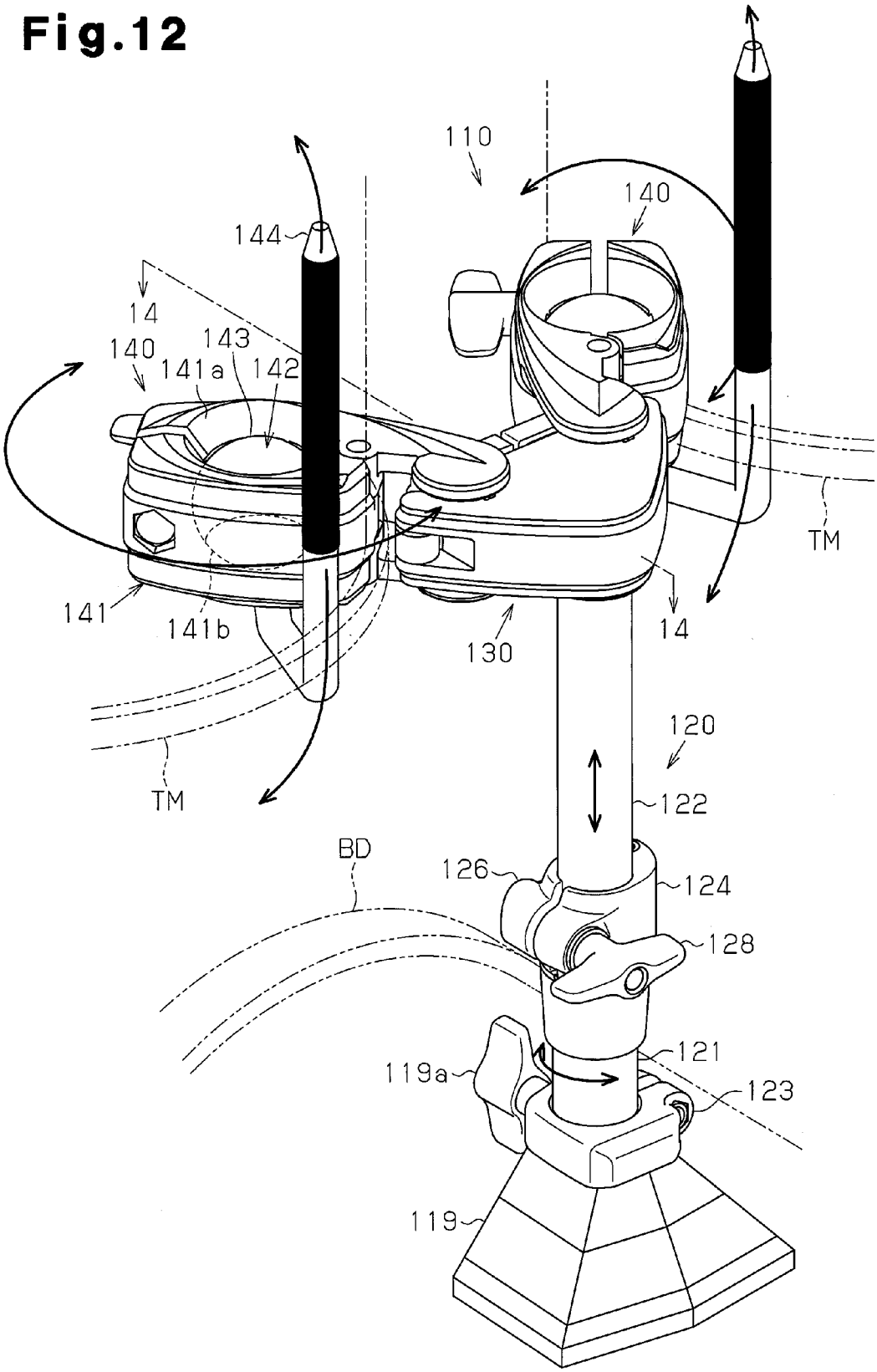
FIG. 12 is a perspective view showing a tom holder according to a third embodiment of the present invention.

As illustrated in FIG. 12, a tom holder 110 has a trapezoidal fixing member 119, a support rod 120, and a pair of mounting bodies 140. The fixing member 119 is fixed to a bass drum BD provided as a structure. The support rod 120 extends upward from the fixing member 119. The pair of mounting bodies 140 is attached to the upper end of the support rod 120 via a base 130. The tom holder 110 is configured in such a manner that a tom TM is mountable on each of the pair of mounting bodies 140. The tom holder 110 supports two toms TM above the bass drum BD. The configuration of the tom holder 110 is described herein with the right side and the left side of FIG. 12 considered to be the back and the front, respectively.

The fixing member 119 is fixed to a body of the bass drum BD using a screw, which is not shown in the drawings. The lower end of the support rod 120 is inserted into the fixing member 119 from above. Furthermore, a T-shaped bolt 119*a* is inserted into the fixing member 119 from a lateral side. Fastening the T-shaped bolt 119*a* fixes the lower end of the support rod 120 to the fixing member 119. Loosening the T-shaped bolt 119*a* makes the support rod 120 rotatable about an axis C1 of the support rod 120 and detached from the fixing member 119.

Figure 13:
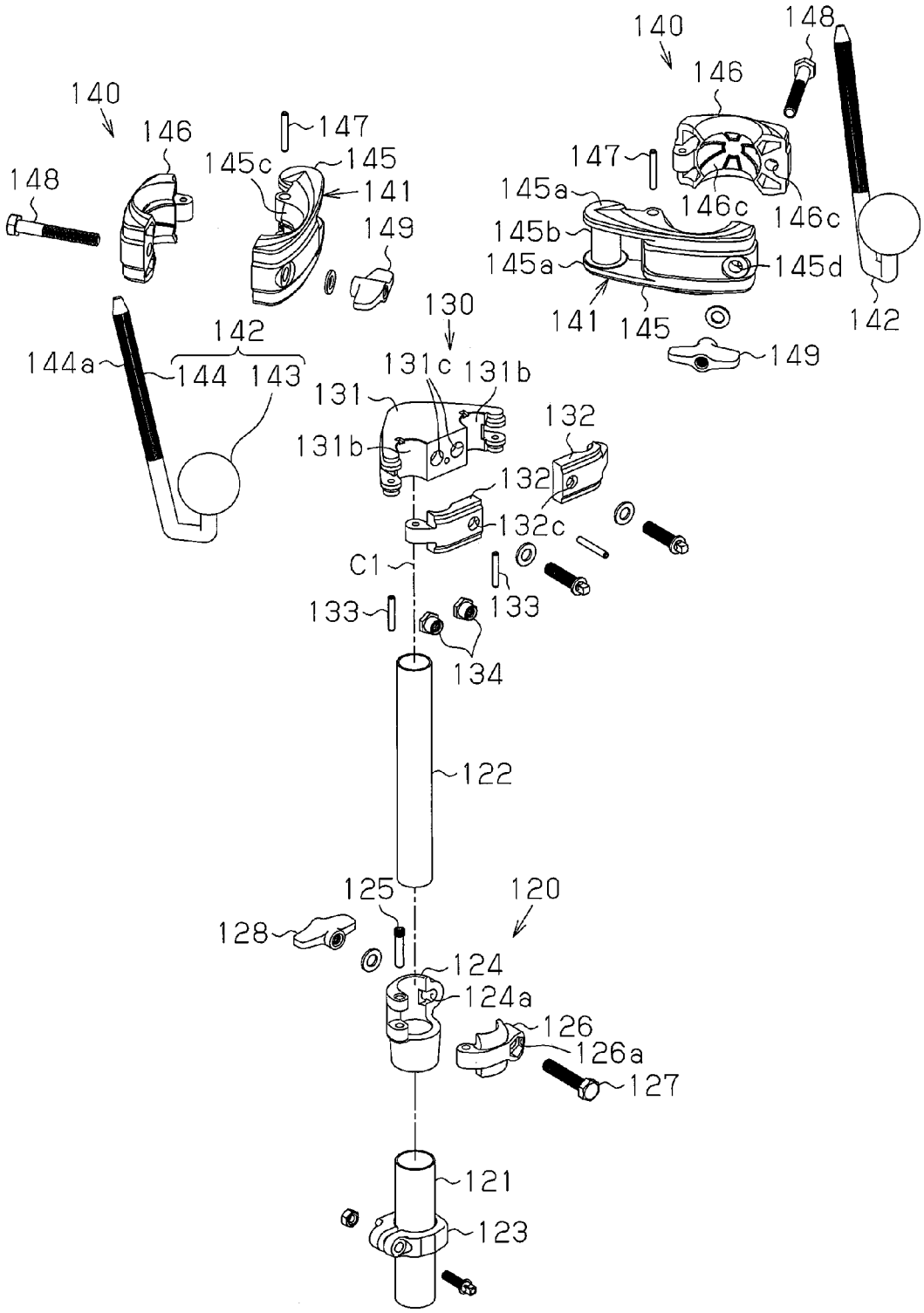
FIG. 13 is an exploded perspective view showing the tom holder.

As illustrated in FIGS. 12 and 13, the support rod 120 has a first pipe 121 supported by the fixing member 119, and a second pipe 122 supported inside the first pipe 121. A memory lock 123 having a substantially annular shape is mounted on the first pipe 121 to memorize the height of the support rod 120 from the bass drum BD. A pipe clamp 124 having a substantially tubular shape is fixed to the upper end of the first pipe 121. A clamp piece 126 is pivotally connected to the pipe clamp 124 via a pin 125. The pipe clamp 124 has a through-hole 124*a* located at the opposite side from a portion connected to the clamp piece 126. Similarly, the clamp piece 126 has a through-hole 126*a* located at the opposite side from a portion connected to the pipe clamp 124.

A bolt 127 is inserted through the through-holes 124*a*, 126*a* in the pipe clamp 124 and the clamp piece 126. A T-shaped nut 128 is threaded onto the distal end of the bolt 127 via a washer. By fastening the T-shaped nut 128, the second pipe 122 is clamped between the pipe clamp 124 and the clamp piece 126. As a result, the second pipe 122 is fixed with respect to the first pipe 121, and therefore the overall length of the support rod 120 can be fixed.

On the other hand, loosening the T-shaped nut 128 makes the first pipe 121 slidable with respect to the second pipe 122. This makes it possible to change the position at which the second pipe 122 is fixed with respect to the first pipe 121, thereby enabling adjustment of the overall length of the support rod 120. Furthermore, loosening the T-shaped nut 128 also makes the second pipe 122 rotatable with respect to the first pipe 121 about the axis C1 of the support rod 120. This makes it possible to adjust the angle of rotation of the second pipe 122 with respect to the first pipe 121 about the axis C1.

Figure 14:
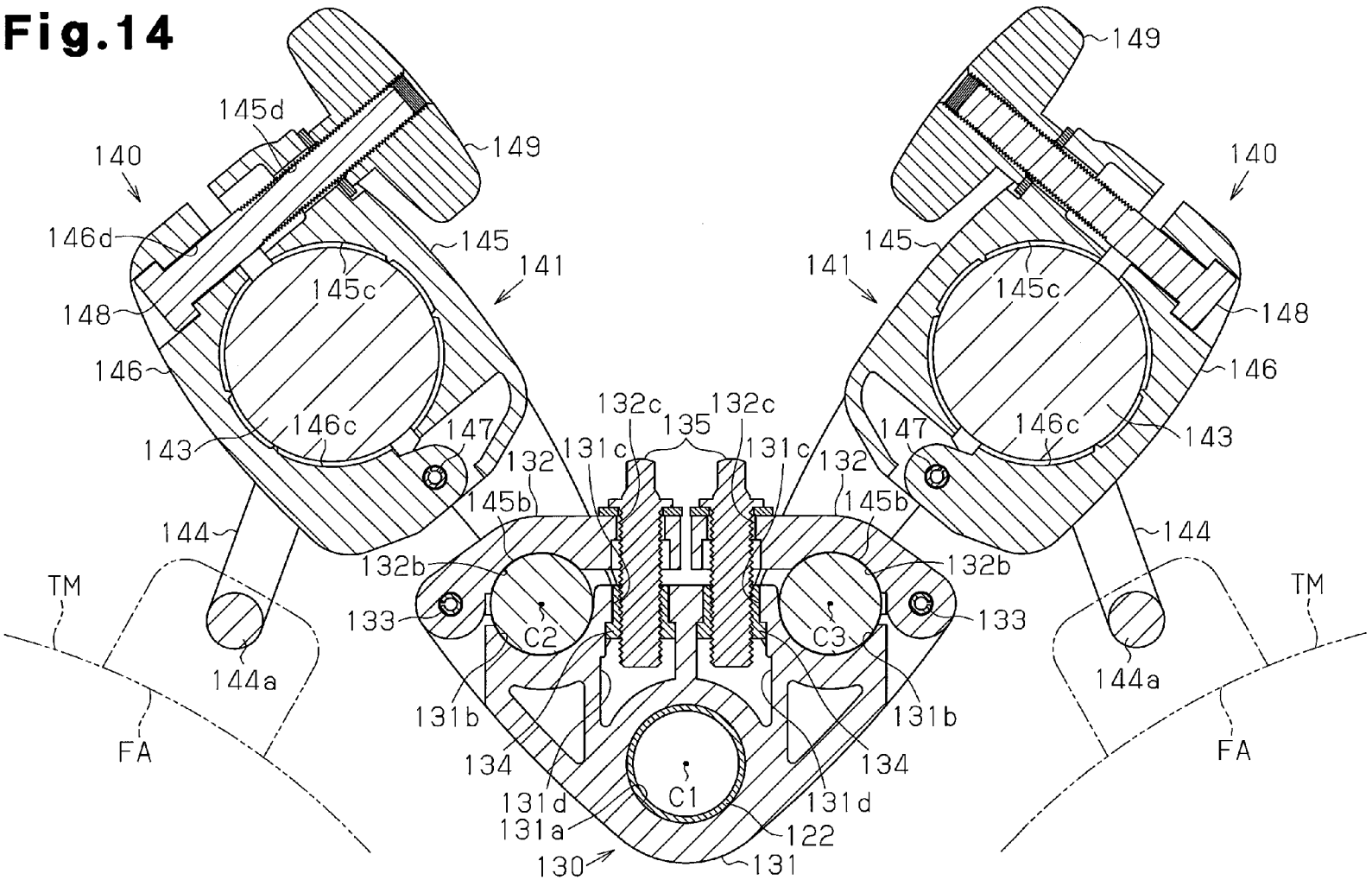
FIG. 14 is a cross-sectional view taken along the line 14-14 in FIG. 12.

As illustrated in FIGS. 13 and 14, the base 130 has a base body 131 fixed to the upper end of the second pipe 122, and a pair of clamp pieces 132 connected to the base body 131. The base body 131 has a substantially triangular shape in a plan view. The base body 131 has a circular insertion hole 131*a* in a corner located at the opposite side from the mounting bodies 140. The upper end of the second pipe 122 is inserted into and fixed to the insertion hole 131*a* in the base body 131.

The clamp pieces 132 are pivotally connected, via pins 133, to corners of the base body 131 located at the opposite sides from the second pipe 122. The base body 131 has a pair of recesses 131*b*. The recesses 131*b* extend along the axis C1 of the support rod 120, on a lateral surface opposing the clamp pieces 132. Similarly, each clamp piece 132 has a recess 132*b*, which extends along a later-described axis C2 or C3, on a lateral surface opposing the base body 131. The recesses 131*b*, 132*b* in the base body 131 and the clamp pieces 132 are all formed to have a substantially semicircular cross-section.

The proximal end of one of the mounting bodies 140 is supported by one of the recesses 131*b* in the base body 131 and by the recess 132*b* in the corresponding clamp piece 132, in a manner pivotal about the axis C2. Similarly, the proximal end of the other mounting body 140 is supported by the other recess 131*b* in the base body 131 and by the recess 132*b* in the corresponding clamp piece 132, in a manner pivotal about the axis C3. That is to say, the pair of mounting bodies 140 is supported independently and pivotally by the base 130 at two corners of the base body 131. The axes C2, C3 are both parallel to the axis C1 of the support rod 120, and are offset from the axis C1 of the support rod 120 in the horizontal direction, which is the vertical direction in FIG. 14.

The base body 131 has two through-holes 131*c* located at the opposite side from portions connected to the clamp pieces 132, that is to say, in the vicinity of the center of the base body 131. Each through-hole 131*c* communicates with a different one of two spaces 131*d* formed in the base body 131. A hexagonal nut 134 is fixed inside each space 131*d* in the base body 131. Similarly, each clamp piece 132 has a through-hole 132*c* located at the opposite side from a portion connected to the base body 131. Bolts 135 are inserted through the through-holes 131*c*, 132*c* in the base body 131 and the clamp pieces 132 via washers. The bolts 135 extend through the through-holes 131*c*, 132*c* in the base body 131 and the clamp pieces 132 and are threaded into the hexagonal nuts 134 in the base body 131.

By firmly fastening the bolts 135 into the hexagonal nuts 134, the proximal ends of the mounting bodies 140 are clamped between the recesses 131*b* in the base body 131 and the recesses 132*b* in the clamp pieces 132. As a result, the mounting bodies 140 are fixed to the base 130. On the other hand, loosening the bolts 135 makes the proximal ends of the mounting bodies 140 pivotal while being clamped between the base body 131 and the clamp pieces 132. That is to say, loosening the bolts 135 makes the mounting bodies 140 pivotal about the axis C2 or C3 while being supported by the base 130.

Figure 15:
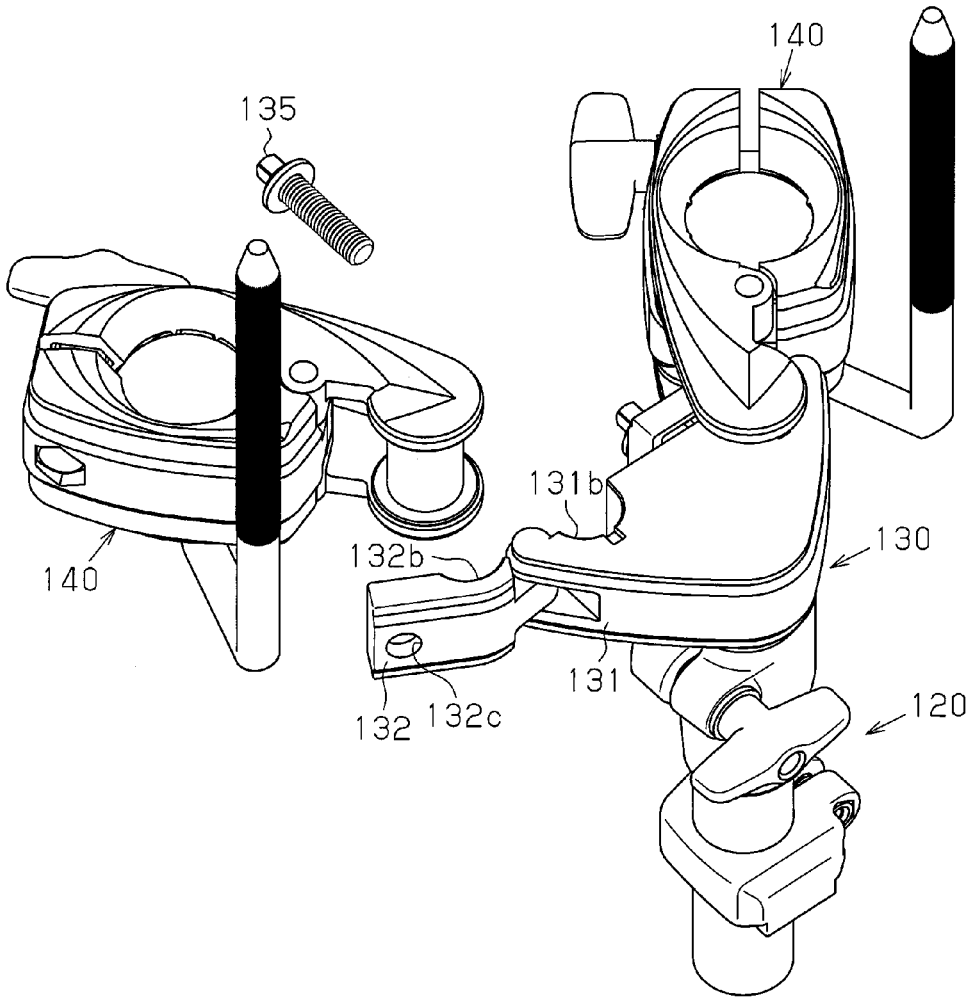
FIG. 15 is a perspective view showing the state where a mounting body has been removed from the tom holder.

As illustrated in FIG. 15, by further loosening the bolts 135 and removing the same from the hexagonal nuts 134, the recesses 132*b* in the clamp pieces 132 are opened with respect to the recesses 131*b* in the base body 131. As a result, the mounting bodies 140 are removed from the base 130. That is to say, the pair of mounting bodies 140 is detachably attached to the base 130 by means of the base body 131 and the pair of clamp pieces 132.

As illustrated in FIGS. 13 and 14, the mounting bodies 140 have holder bodies 141 attached to the base 130, and pivoting components 142 supported pivotally with respect to the holder bodies 141. The pivoting components 142 are composed of balls 143 and U-shaped rods 144 projecting from the balls 143. The rods 144 have straight portions 144*a* extending upward in a straight manner. The straight portions 144*a* of the rods 144 are inserted through the through-holes in fixing tools FA, which are provided to the shells of the toms TM. The toms TM are attached to the straight portions 144*a* of the rods 144 via the fixing tools FA.

The holder bodies 141 have clamp bodies 145 and clamp pieces 146 supported by the clamp bodies 145. A pair of upper and lower arms 145*a* is formed in the proximal end of each clamp body 145. Each of the arms 145*a* extends in the longitudinal direction of the corresponding clamp body 145. Furthermore, a cylindrical shaft portion 145*b* connecting between the arms 145*a* is formed in the proximal end of each clamp body 145. By clamping the shaft portions 145*b* between the base body 131 and the clamp pieces 132, the holder bodies 141 are attached to and pivotally supported by the base 130.

Each clamp piece 146 is pivotally connected to the substantial center of the corresponding clamp body 145 via a pin 147. The clamp bodies 145 have recesses 145*c* on the inner surfaces opposing the clamp pieces 146. The balls 143 are rotationally supported by the recesses 145*c*. Similarly, the clamp pieces 146 have recesses 146*c* on the inner surfaces opposing the clamp bodies 145. The balls 143 are rotationally supported by the recesses 146*c*. The recesses 145*c*, 146*c* in the clamp bodies 145 and the clamp pieces 146 are all formed to have substantially spherical surfaces of the same dimensions as the balls 143.

The clamp bodies 145 have through-holes 145*d* located at the opposite sides from portions connected to the clamp pieces 146. Similarly, the clamp pieces 146 have through-holes 146*d* located at the opposite sides from portions connected to the clamp bodies 145. Bolts 148 are inserted through the through-holes 145*d*, 146*d* in the clamp bodies 145 and the clamp pieces 146. The bolts 148 extend through the through-holes 145*d*, 146*d* in the clamp bodies 145 and the clamp pieces 146, and are threaded into T-shaped nuts 149 via washers.

By firmly fastening the T-shaped nuts 149 onto the bolts 148, the balls 143 are clamped between the clamp bodies 145 and the clamp pieces 146. As a result, the pivoting components 142 are fixed to the holder bodies 141. On the other hand, loosening the T-shaped nuts 149 makes the balls 143 rotational while being clamped between the clamp bodies 145 and the clamp pieces 146. That is to say, loosening the T-shaped nuts 149 makes the pivoting components 142 pivotal while being supported by the holder bodies 141, and makes the rods 144 movable in the vertical and horizontal directions over a wide range around the holder bodies 141.

By further loosening the T-shaped nuts 149 and detaching the bolts 148 from the insertion holes 145*d*, 146*d* in the clamp bodies 145 and the clamp pieces 146, the recesses 146*c* in the clamp pieces 146 are opened with respect to the recesses 145*c* in the clamp bodies 145. As a result, the pivoting components 142 are removed from the holder bodies 141. That is to say, the pivoting components 142 are detachably attached to the holder bodies 141 by means of the clamp bodies 145 and the clamp pieces 146.

Operation of the above-described tom holder 10 will hereafter be described with reference to FIGS. 12 to 16C.

Figure 11:
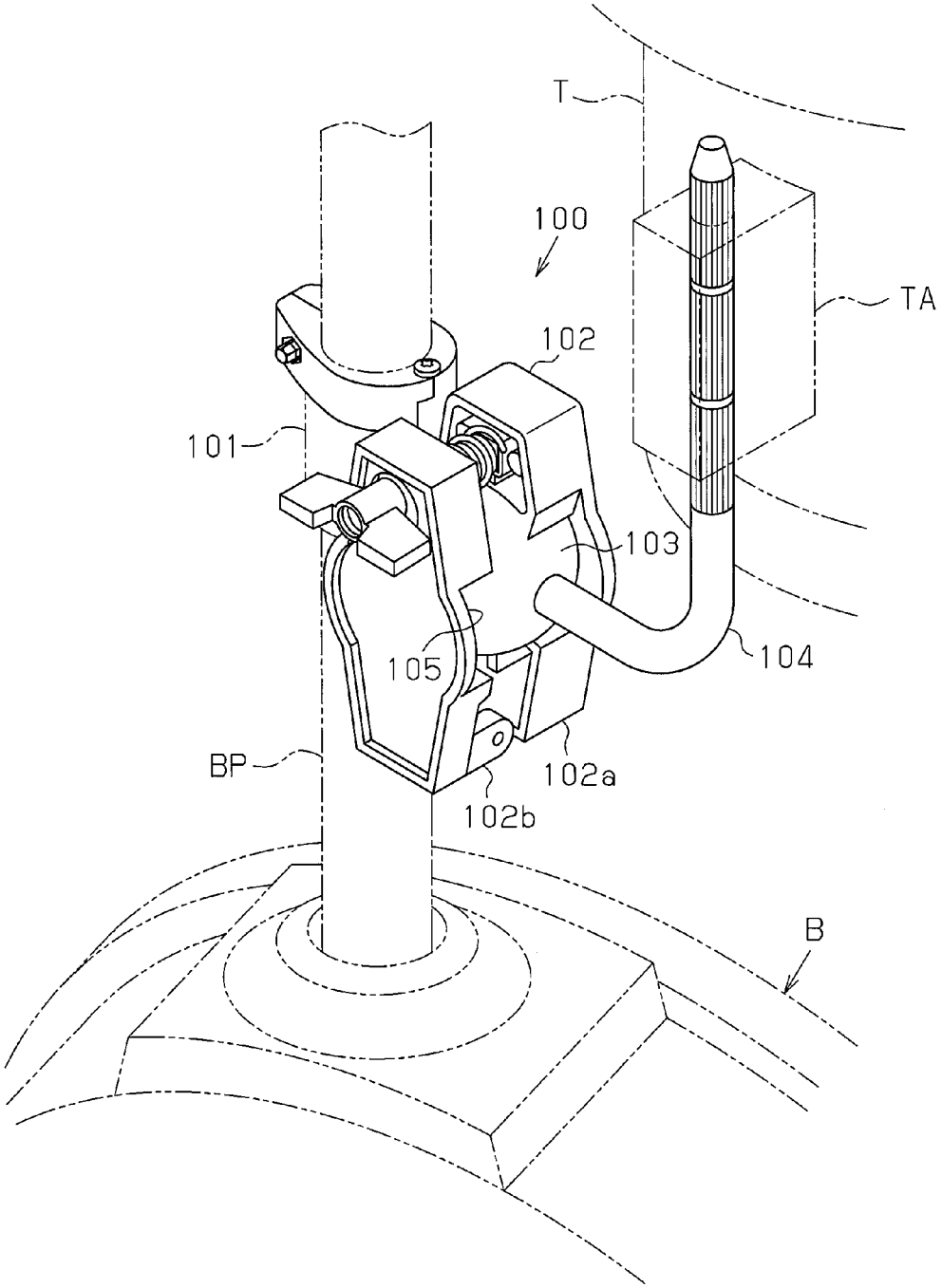
Fig.11 Prior Art
FIG. 11 is a perspective view showing a conventional tom holder.

As illustrated in FIG. 12, one opening 141*a* and another opening 141*b* are respectively formed in the upper and lower surfaces of each holder body 141. The rods 144 project from the openings 141*a* and 141*b*. The pivoting components 142 are supported by the holder bodies 141 with the rods 144 projecting downward from the openings 141*b* located on the lower surfaces of the holder bodies 141, and the distal ends of the rods 144 facing upward. In this state, the balls 143 are partially exposed from the openings 141*a* and 141*b*, which are respectively located on the upper and lower surfaces of the holder bodies 141. In this configuration, the movable range of the rods 114 can be enlarged compared to the conventional configuration illustrated in FIG. 11, in which a holder body has only one opening, from which a rod projects, in the front surface thereof. That is to say, as indicated by corresponding arrows in FIG. 12, the rods 144 can be moved in the vertical and horizontal directions over a wide range around the holder bodies 141. Accordingly, the adjustment range of the positions of the toms TM can be enlarged compared to conventional apparatuses.

Figure 16A:
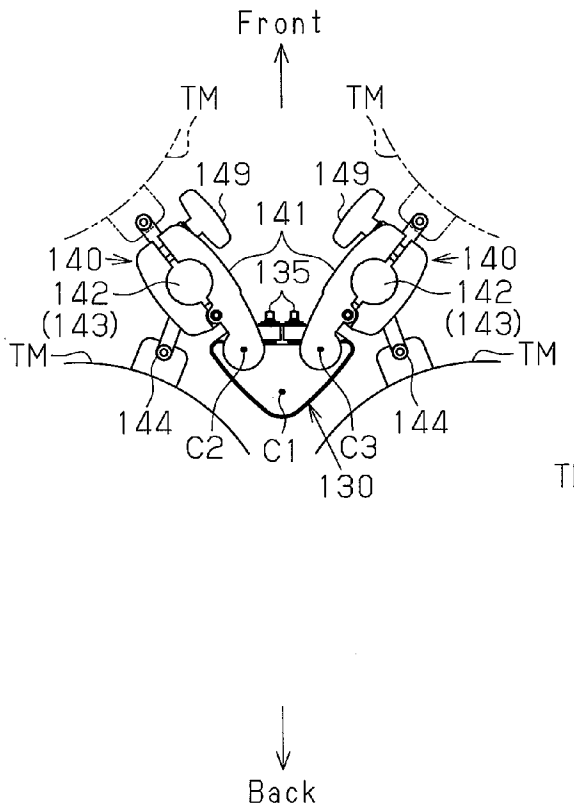
FIGS. 16A to 16C are plan views illustrating procedures for adjusting the positions of two toms in the front-back direction.
Figure 16B:
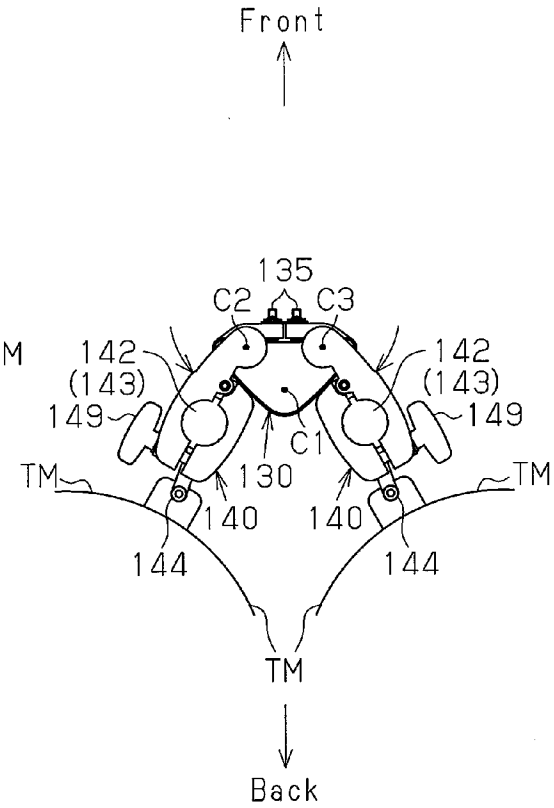

Furthermore, with the enlarged movable range of the rods 144, the positions of the two toms TM can be adjusted in the front-back direction as illustrated in FIGS. 16A and 16B. In the state illustrated in FIG. 16A, the two toms TM are arranged laterally next to each other on the same side as a player. To bring the toms TM close to the player, it is necessary to move the toms TM toward the back while keeping the gap therebetween small.

In this case, the bolts 135 in the base 130 are loosened to make the mounting bodies 140 pivotal, and then the T-shaped nuts 149 in the mounting bodies 140 are loosened to make the pivoting components 142 pivotal. Next, as indicated by the alternate long-and-two-short dashed lines in FIG. 16A, the pivoting components 142 are moved to be arranged at positions without interfering with the toms TM. Subsequently, as illustrated in FIG. 16B, the left mounting body 140 is pivoted about the axis C2 in the counter-clockwise direction, and the right mounting body 140 is pivoted about the axis C3 in the clockwise direction. At this time, pivot of the base 130 about the axis C1 is restricted.

After arranging the mounting bodies 140 and the toms TM at the positions indicated in FIG. 16B, the mounting bodies 140 are fixed to the base 130 by fastening the bolts 135. Furthermore, by operating the T-shaped nuts 149, the positions of the toms TM and the angle at which the drumheads of the toms TM are struck are finely adjusted. Following the adjustment, the T-shaped nuts 149 are fastened to fix the positions of the toms TM and the angle at which the drumheads of the toms TM are struck. In the series of operational procedures described above, movement to the positions where there is no interference with the toms TM, and movement from such positions to the positions indicated in FIG. 16B are realized due to the enlarged movable range of the rods 144.

Furthermore, according to the present embodiment, the base 130 is pivotal about the axis C1 of the support rod 120, the mounting bodies 140 are attachable to and detachable from the base 130, and the axes C2, C3, which are pivot axes of the mounting bodies 140, are shifted from the axis C1 of the support rod 120 in the horizontal direction. Therefore, the positions of the two toms TM can be adjusted further toward the back as illustrated in FIGS. 16B and 16C.

In this case, the toms TM are removed from the mounting bodies 140. After removing the toms TM, the T-shaped bolt 119*a* and the T-shaped nut 128 are loosened to pivot the base 130 by 180 degrees about the axis C1 and arrange the base 130 at the position indicated in FIG. 16C. Then, the bolts 135 are loosened to remove the mounting bodies 140 from the base 130. Subsequently, the removed left and right mounting bodies 140 are reversed, and then re-attached to the base 130. As a result, the mounting bodies 140 are attached to the base 130 with the T-shaped nuts 149 located at positions opposite from the positions at which the T-shaped nuts 149 were located before the mounting bodies 140 were removed from the base 130.

Figure 16C:
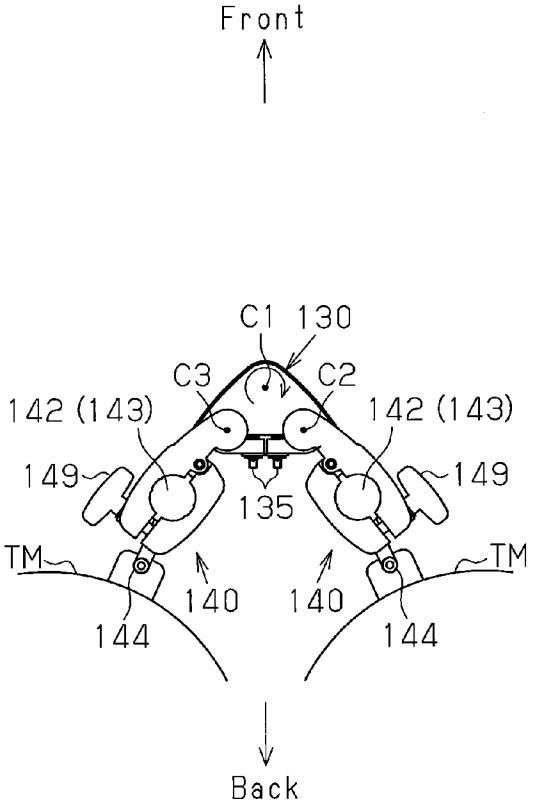

Next, the tom TMs are attached to the mounting bodies 140, and then the mounting bodies 140 and the toms TM are moved to be arranged at the positions indicated in FIG. 16C. After arranging the mounting bodies 140 and the toms TM at the positions indicated in FIG. 16C, the T-shaped bolt 119*a* and the T-shaped nut 128 are fastened to restrict pivot of the base 130 about the axis C1. Also, the bolts 135 are fastened to fix the mounting bodies 140 to the base 130. Furthermore, by operating the T-shaped nuts 149, the positions of the toms TM and the angle at which the drumheads of the toms TM are struck are finely adjusted. At this time, in each mounting body 140, the T-shaped nut 149 is arranged at the opposite side from the corresponding tom TM. Therefore, the toms TM and the T-shaped nuts 149 do not interfere with each other when adjusting the positions of the toms TM.

The third embodiment has the advantages described below.

(9) The tom holder 110 has the support rod 120, the base 130 supported by the upper portion of the support rod 120, and the pair of mounting bodies 140 supported by the base 130. The mounting bodies 140 have holder bodies 141 attached to the base 130, and pivoting components 142 supported pivotally with respect to the holder bodies 141. The pivoting components 142 are supported by the holder bodies 141 with the U-shaped rods 144 projecting downward from the openings 141*b* located on the lower surfaces of the holder bodies 141, and the distal ends of the rods 144 facing upward. In this configuration, the movable range of the rods 144 can be enlarged compared to the conventional configuration illustrated in FIG. 11, in which a holder body has only one opening, from which a rod projects, in the front surface thereof. That is to say, the rods 144 can be moved in vertical and horizontal directions over a wide range around the holder bodies 141. Accordingly, the adjustment range of the positions of the toms TM can be enlarged compared to conventional apparatuses.

Figure 17:
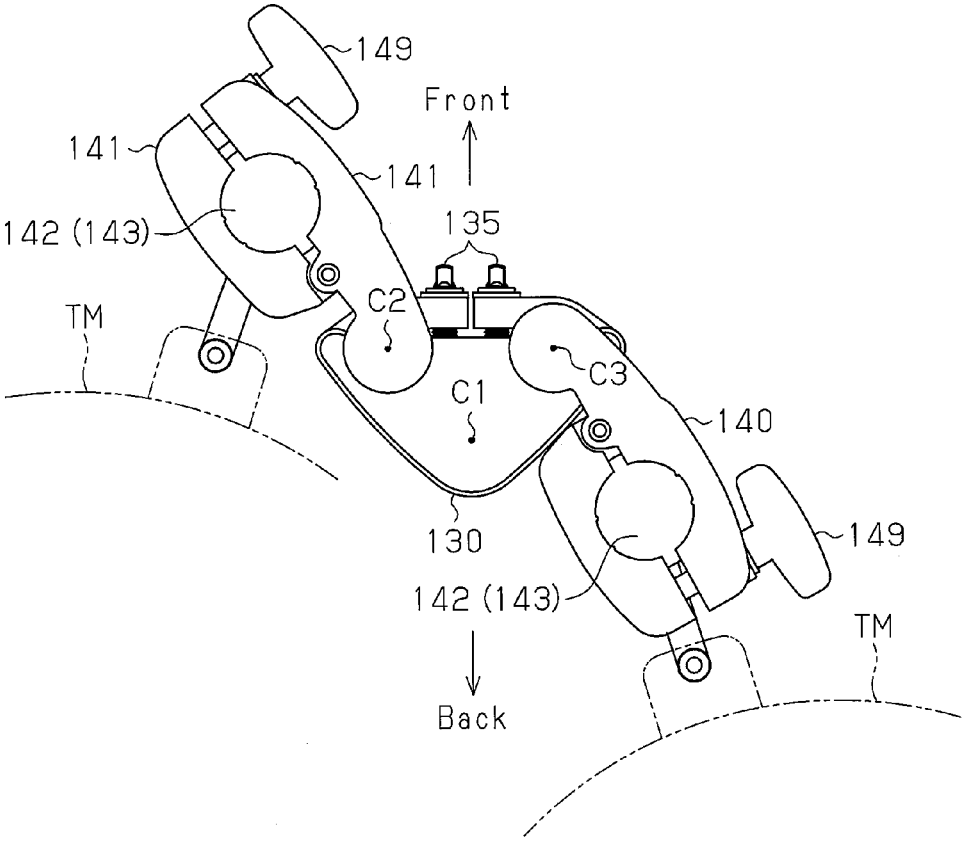
FIG. 17 is a plan view showing the tom holder.

(10) Each of the pair of mounting bodies 140 is supported independently and pivotally by the base 130. In this configuration, when two toms TM are attached to the support rod 120 via the tom holder 110, the positions of the two toms TM can be adjusted separately as illustrated in FIG. 17. Therefore, variations in the positions of the two toms TM can be increased.

(11) Loosening the T-shaped bolt 119*a* makes the support rod 120, which is inserted into the fixing member 119, rotatable about the axis C1 of the support rod 120. Furthermore, loosening the T-shaped nut 128 makes the second pipe 122 rotatable with respect to the first pipe 121 about the axis C1 of the support rod 120. In addition, each of the pair of mounting bodies 140 is supported independently and pivotally by the base 130. As a result, when two toms TM are attached to the support rod 120 via the tom holder 110, the adjustment range of the positions of the two toms TM is further enlarged.

(12) The pair of mounting bodies 140 is detachably attached to the base 130 by means of the base body 131 and the pair of clamp pieces 132. In this configuration, one of the pair of mounting bodies 140 attached to the base 130 can be removed and replaced with a mounting body 140 on which an instrument other than a tom, such as cymbals, is mounted. As a result, variations in the usage of the tom holder 110 can be increased.

(13) The base 130 is pivotal about the axis C1 of the support rod 120. The mounting bodies 140 are attachable to and detachable from the base 130. The axes C2, C3, which are pivot axes of the mounting bodies 140, are shifted from the axis C1 of the support rod 120 in the horizontal direction. Accordingly, after pivoting the base 130 by 180 degrees about the axis C1, the mounting bodies 140 can be removed from the base 130, the removed left and right mounting bodies 140 can be reversed, and the reversed mounting bodies 140 can be re-attached to the base 130. In this way, the adjustment range of the positions of the toms TM can be further enlarged in the horizontal direction as illustrated in FIGS. 16B and 16C.

(14) One opening 141*a* and another opening 141*b* are respectively formed in the upper and lower surfaces of each holder body 141. The rods 144 project from the openings 141*a* and 141*b*. This configuration has operational advantages equivalent to those according to the invention described in the above (9), even when the mounting bodies 140 are reversed upside down during use. Furthermore, when the tom holder 110 has the pair of mounting bodies 140 as in the third embodiment, reversing one of the mounting bodies 140 upside down allows this mounting body 140 to be used as the other mounting body 140. Therefore, components of the mounting bodies 140 can be commonly shared.

(15) The support rod 120 has the first pipe 121 and the second pipe 122 supported inside the first pipe 121. Loosening the T-shaped nut 128 makes the first pipe 121 slidable with respect to the second pipe 122, thereby making it possible to change the position at which the second pipe 122 is fixed with respect to the first pipe 121. In this configuration, the position at which the second pipe 122 is fixed with respect to the first pipe 121 can be changed, and therefore the overall length of the support rod 120 can be adjusted. Accordingly, the positions of the toms TM with respect to the bass drum BD can be adjusted in the height direction. As a result, the adjustment range of the positions of the toms TM can be enlarged in the height direction.

The third embodiment may be modified as follows.

Figure 18:
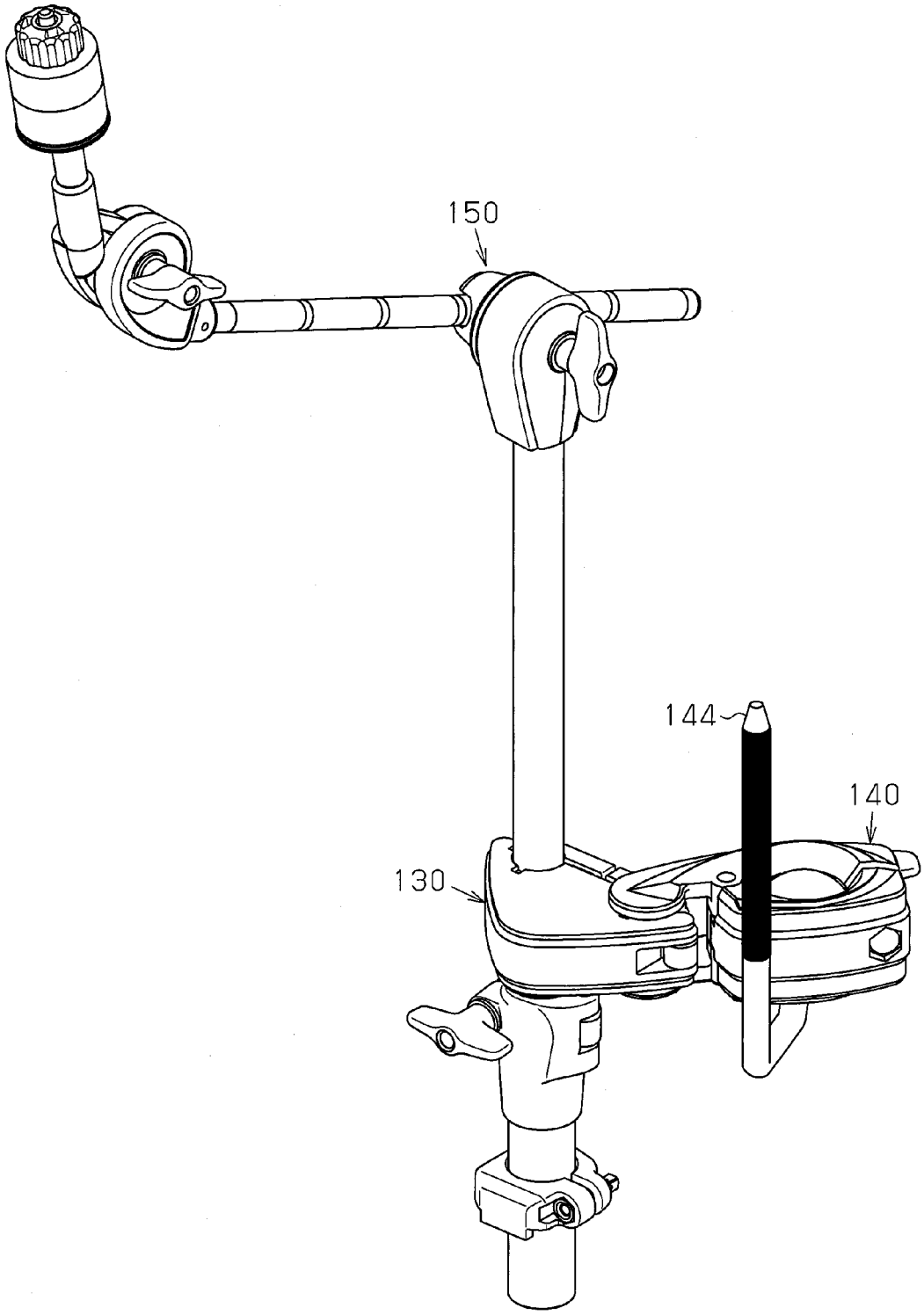
FIG. 18 is a perspective view showing the tom holder to which a cymbal attachment has been attached.

In the third embodiment, one of the pair of mounting bodies 140 attached to the base 130 may be removed and replaced with a cymbal attachment 150 as illustrated in FIG. 18. A tom holder may be configured to support one tom TM by removing one of the pair of mounting bodies 140 attached to the base 130. Alternatively, a tom holder may be configured to support three or more toms M.

Figure 19:
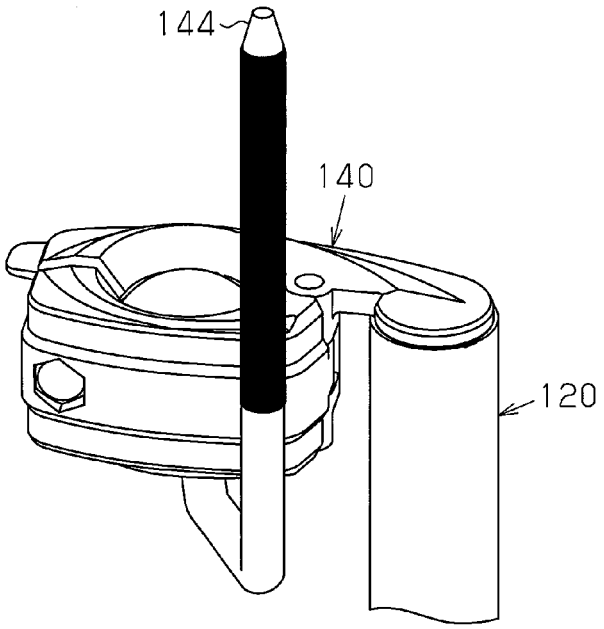
FIG. 19 is a perspective view showing a tom holder according to a modification.

In the third embodiment, the mounting bodies 140 are attached to the upper end of the support rod 120 via the base 130. Alternatively, the mounting bodies 140 may be attached directly to the upper end of the support rod 120 without using the base 130 as illustrated in FIG. 19.

In the third embodiment, one opening 141*a* and another opening 141*b*, from which the rod 144 projects, are respectively formed in the upper and lower surfaces of each holder body 141. Alternatively, the opening 141*a* may not be formed in the upper surface of each holder body 141.

Figure 20:
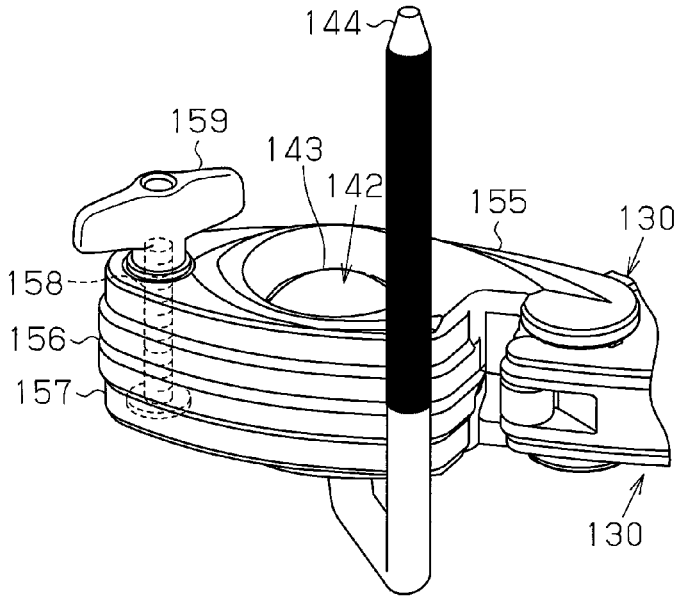
FIG. 20 is a perspective view showing a tom holder according to another modification.

In the third embodiment, the holder bodies 141 are configured in such a manner that the lateral sides of the balls 143 are clamped between the clamp bodies 145 and the clamp pieces 146. Alternatively, the upper and lower sides of the balls 143 may be clamped. For example, as illustrated in FIG. 20, a holder body 155 may be composed of a pair of upper and lower clamp pieces 156, 157, a bolt 158, and a T-shaped nut 159. In this case, the clamp pieces 156, 157 have through-holes located at the opposite sides from portions connected to the base 130. The bolt 158 is inserted through the through-holes in the clamp pieces 156, 157 and threaded into the T-shaped nut 159. In this configuration, fastening the T-shaped nut 159 onto the bolt 158 makes the ball 143 clamped between the clamp pieces 156, 157, thereby fixing the pivoting component 142 with respect to the holder body 155.

In the third embodiment, the support rod 120 is composed of the first and second pipes 121, 122. Alternatively, the support rod 120 may be composed of a single pipe. That is to say, the tom holder 110 may not have the function of adjusting the length of the support rod 120.

In the third embodiment, the tom holder 110 is configured to support the toms TM above the bass drum BD. Alternatively, the tom holder 110 may be configured to, for example, support the toms TM using stands with foldable legs. Alternatively, the tom holder 110 may be configured to have the second clamp structure that clamps the support pipe SP as illustrated in FIG. 5A.

In the third embodiment, memory locks for memorizing the positions at which the toms TM are attached may be mounted on the rods 144.

The invention claimed is:

1. A tom holder comprising:

a support rod fixed to a structure;

a mounting body on which a tom is mounted, wherein the mounting body is arranged on an upper portion of the support rod; and a base pivotally supporting the mounting body, wherein the base is fixed to the support rod, the mounting body has a holder body and a pivoting component, the holder body is pivotally attached to the base, and the pivoting component is pivotally supported with respect to the holder body, the pivoting component has a U-shaped rod to which the tom is attached, a lower surface of the holder body has an opening from which the U-shaped rod projects, and the pivoting component is supported by the holder body with the U-shaped rod projecting downward from the opening in the holder body and a distal end of the U-shaped rod extending upward.

2. The tom holder according to claim 1, wherein the mounting body is one of a plurality of mounting bodies, and each of the mounting bodies is supported independently and pivotally by the upper portion of the support rod via the base.

3. The tom holder according to claim 2, wherein the mounting bodies are detachably attached to the base.

4. The tom holder according to claim 2, wherein positions at which the mounting bodies are attached to the base are shifted from a position at which the base is attached to the support rod in a horizontal direction perpendicular to an axis of the support rod.

5. The tom holder according to claim 1, wherein an upper surface and the lower surface of the holder body each have an opening from which the U-shaped rod can project.

6. The tom holder according to claim 1, wherein the support rod has a first pipe fixed to the structure and a second pipe supported slidably with respect to the first pipe, and a length of the support rod is adjusted by changing a position at which the second pipe is fixed with respect to the first pipe.

7. A tom holder comprising:

a support rod fixed to a structure;

a mounting body on which a tom is mounted, wherein the mounting body is arranged on an upper portion of the support rod; and a base pivotally supporting the mounting body, wherein the base is fixed to the support rod, wherein the base has a substantially triangular shape in a plan view, and the mounting body has a holder body and a pivoting component, the holder body is attached to a corner of the base, and the pivoting component is supported pivotally with respect to the holder body, the pivoting component has a U-shaped rod to which the tom is attached, a lower surface of the holder body has an opening from which the U-shaped rod projects, and the pivoting component is supported by the holder body with the U-shaped rod projecting downward from the opening in the holder body and a distal end of the U-shaped rod extending upward.

* * * * *